US005642712A

United States Patent [19]

Biondo

[11] Patent Number: 5,642,712

[45] Date of Patent: Jul. 1, 1997

[54] ADJUSTABLE TIME OPERATED THROTTLE BASED ON ACTUAL RACE CONDITIONS

[75] Inventor: Sam Biondo, Valley Stream, N.Y.

[73] Assignee: Biondo Racing Products, Inc., Valley Stream, N.Y.

[21] Appl. No.: 614,367

[22] Filed: Mar. 12, 1996

[51] Int. Cl.[6] ..... F02D 9/02

[52] U.S. Cl. ..... 123/398; 123/394; 123/396

[58] Field of Search ..... 123/333, 335, 123/394, 396, 398, 399, 352

[56] References Cited

U.S. PATENT DOCUMENTS

| | | | |
|---|---|---|---|
| Re. 32,474 | 8/1987 | Reid | 307/10 R |
| 2,840,064 | 6/1958 | Hofer | 123/332 |
| 3,517,653 | 6/1970 | Hajime Ariga et al. | 123/325 |
| 3,923,020 | 12/1975 | Gilligan | 123/342 |
| 4,286,685 | 9/1981 | Rudolf et al. | 180/176 |
| 4,362,138 | 12/1982 | Krueger et al. | 123/342 |
| 4,424,876 | 1/1984 | Filho | 180/175 |
| 4,462,372 | 7/1984 | Jackson | 123/452 |
| 4,493,303 | 1/1985 | Thompson et al. | 123/357 |
| 4,524,741 | 6/1985 | Corbi | 123/342 |
| 4,556,032 | 12/1985 | Miller | 123/437 |
| 4,574,752 | 3/1986 | Reichart, Jr. et al. | 123/198 DB |
| 4,784,099 | 11/1988 | Noe et al. | 123/398 |
| 4,812,671 | 3/1989 | Furrow | 123/333 X |
| 4,840,157 | 6/1989 | Furrow | 123/352 |
| 5,080,619 | 1/1992 | Uchida et al. | 440/84 |
| 5,200,900 | 4/1993 | Adrain et al. | 123/486 X |

OTHER PUBLICATIONS

Digital Delay, Inc., Throttle Controls, Davenport, Iowa. (No date).

K&R Performance Engineering, Inc., Operating Manual for Model XTC–200, Chuluota, Florida. (No date).

Dedenbear Products, Inc., Catalog & Technical Guide, vol. 3, pp. 13, 14 and back page, Pleasant Hill, CA, 1994.

Biondo Racing Products, Inc., Catalog (vol. 1), p. 9, Valley Stream, NY. (No date).

*Primary Examiner*—Tony M. Argenbright

*Attorney, Agent, or Firm*—John R. Mugno

[57] ABSTRACT

A two-stage time operated throttle and method is described for use on a drag racing vehicle comprising: (i) an electro-mechanical controller for selectively opening and closing the throttle of the vehicle; (ii) an on-board processor capable of issuing an open throttle control signal and a close throttle control signal; (iii) a first adjustable timer set prior to launch to a predetermined first value whereby, upon expiration of the first value, a close throttle signal is issued; (iv) a second adjustable timer set prior to launch to a predetermined second value, which is greater than the first value whereby, upon expiration of the second value, an open throttle control signal is issued; and (v) a signal for modifying at least one of the first and second values subsequent to launch based on actual race conditions. A four-stage time operated throttle and method is also provided by adding a third timer and a fourth timer. Additionally, a signal for modifying the values in the third and fourth timers can also be issued to permit maximum adjustability.

44 Claims, 4 Drawing Sheets

STAGE LAUNCH
END
TRIGGER
TIMER 1
TIMER 2
THROTTLE (NORMALLY OPEN) OUTPUT
TIME (SECONDS)
0
1
2
3
4
5
6
7
8
9

STAGE LAUNCH
END
TRIGGER
TIMER 1
TIMER 2
TIMER 3
TIMER 4
THROTTLE (NORMALLY OPEN) OUTPUT
TIME (SECONDS)

0
1
2
3
4
5
6
7
8
9
I
II

ADJUSTABLE TIME OPERATED THROTTLE BASED ON ACTUAL RACE CONDITIONS

FIELD OF THE INVENTION

This invention is generally directed to an improved time operated throttle and method for controlling a drag racing vehicle, and more particularly, to a throttle stop controller timer which is adjustable based on actual race conditions encountered subsequent to launch.

BACKGROUND OF THE INVENTION

In drag racing, the objective is to complete the short track race before a competitor while, at the same time, maintaining a total race time which does not fall under a preset minimum time. This preset time is typically referred to as an index time and is established to ensure close results between competitors. If a car completes the race in a time under the index time, the racer is declared the loser by disqualification.

As described in prior art Noe et al. U.S. Pat. No. 4,784,099, drag racing vehicles are typically designed to run faster than the allotted index time if the vehicle is maintained at full throttle. Designing the vehicle with a speed capacity which would allow it to complete a race under the allotted index time guarantees that the vehicle will have sufficient power (and speed) under all racing conditions. However, this excess power must be controlled so as to complete the race in a total time in excess of the allotted index time, thereby avoiding disqualification.

The Noe et al. prior art reference describes a specific example of what is commonly referred to as a two-stage (or dual stage) throttle stop controller. In essence, the throttle, while wide open at launch to reach maximum acceleration, will be closed for a period of time during the race so that the car does not run at an overall speed quicker than the allotted index time would allow.

Two-stage throttle stop controllers are operated by setting two timers prior to launch. Launch is generally understood to refer to the time the vehicle begins forward acceleration. The two timers begin to run upon launch of the vehicle. When the first timer expires, the throttle will be shut. Upon expiration of the second timer, the throttle will again be opened as it was at launch. Obviously, the difference between the values preset in the first and second timers is equivalent to the time in which the throttle will be closed. The result of such a two-stage throttle is a vehicle which launches at full throttle (for the lowest reaction time), reduces power at mid-track, and then reaches maximum power once again for the end of race ("top-end") charge. In reality, then, the term "two-stage" throttle controller is a misnomer since three separate stages (full throttle, closed throttle, followed by full throttle) are actually achieved.

More recently, four-stage controllers have been incorporated and approved by the National Hot Rod Association ("NHRA"). A four-stage throttle controller uses four timers which result in two separate periods during the race (after launch) in which the throttle will be closed. The main purpose of the second period of time during which the throttle is closed (a duration equal to the difference between the third and fourth timers), which is programmed to occur near the finish line, is to confuse your opponent into thinking there is a risk of running under the allotted index time. Ideally, your opponent would jam on his/her brake to avoid such a disqualification, your fourth timer would expire thus reopening your throttle, thereby permitting you to cruise to victory.

Whether a two-stage throttle controller, a four-stage throttler controller, or some other variation throttle controller is incorporated, the significant factor is when, and for what length of time, the throttle will be closed or, in other words, what values the timers are set. In present day drag racing vehicles, these values are predetermined prior to launch based on anticipated race conditions, including the anticipated speed of the vehicle. Unfortunately, actual race conditions (and speed) rarely match what was anticipated.

Of course, one significant factor in determining the victor in a drag race is the reaction time at the start. The activation of the starting lights is typically referred to as "stages" and precedes the time of launch. During the time between stage and launch, the throttle is open, but a transbrake is set thereby preventing forward acceleration. New delay boxes can calculate pre-launch factors thereby modifying the time between stage and launch. One specific type of delay box is described in Reid U.S. Pat. No. Re. 32,474. While modification in the launch time will effect the initiation of the decrementing of the timers in the throttle controller, the throttle actually stays on and off subsequent to launch for the same period of time. However, even if such delay boxes, which control pre-launch calculations, could calculate certain pre-launch factors rapidly enough to adjust the values of the timers in the throttle controller, this would be of no use to the driver who encounters post-launch factors such as tire slippage (which will, of course, slow the vehicle), excessively good tire traction (which, of course, will result in a race time under the allotted index time), etc.

In view of the aforementioned and other deficiencies in the prior art, it is therefore an object of the present invention to provide a new and improved time operated throttle and method which can modify the operation of the throttle based on post-launch conditions.

It is yet another object of the present invention to provide a new and improved time operated throttle and method whereby the modification to the operation of the throttle can be controlled by a driver based on post-launch conditions.

Further objects and advantages of the present invention will become apparent as the following description proceeds.

SUMMARY OF THE INVENTION

Briefly stated and in accordance with the preferred embodiment of the present invention, a two-stage time operated throttle and method is described comprising: (i) means for selectively opening and closing the throttle; (ii) a processing means capable of issuing an open throttle control signal and a close throttle control signal; (iii) a first adjustable timer set prior to launch to a predetermined first value whereby, upon expiration of the first value, a close throttle signal is issued; (iv) a second adjustable timer set prior to launch to a predetermined second value which is greater than the first value whereby, upon expiration of said second value, said open throttle control signal is issued; and (v) means for modifying at least one of said first and second values subsequent to launch. A four-stage time operated throttle and method is also provided by adding a third timer and a fourth timer. Additionally, means for modifying the values in the third and fourth timers can be provided to permit maximum adjustability.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the following description, taken in conjunction with the accompanying drawings, wherein:

DETAILED DESCRIPTION OF THE DRAWINGS

Figure 1:
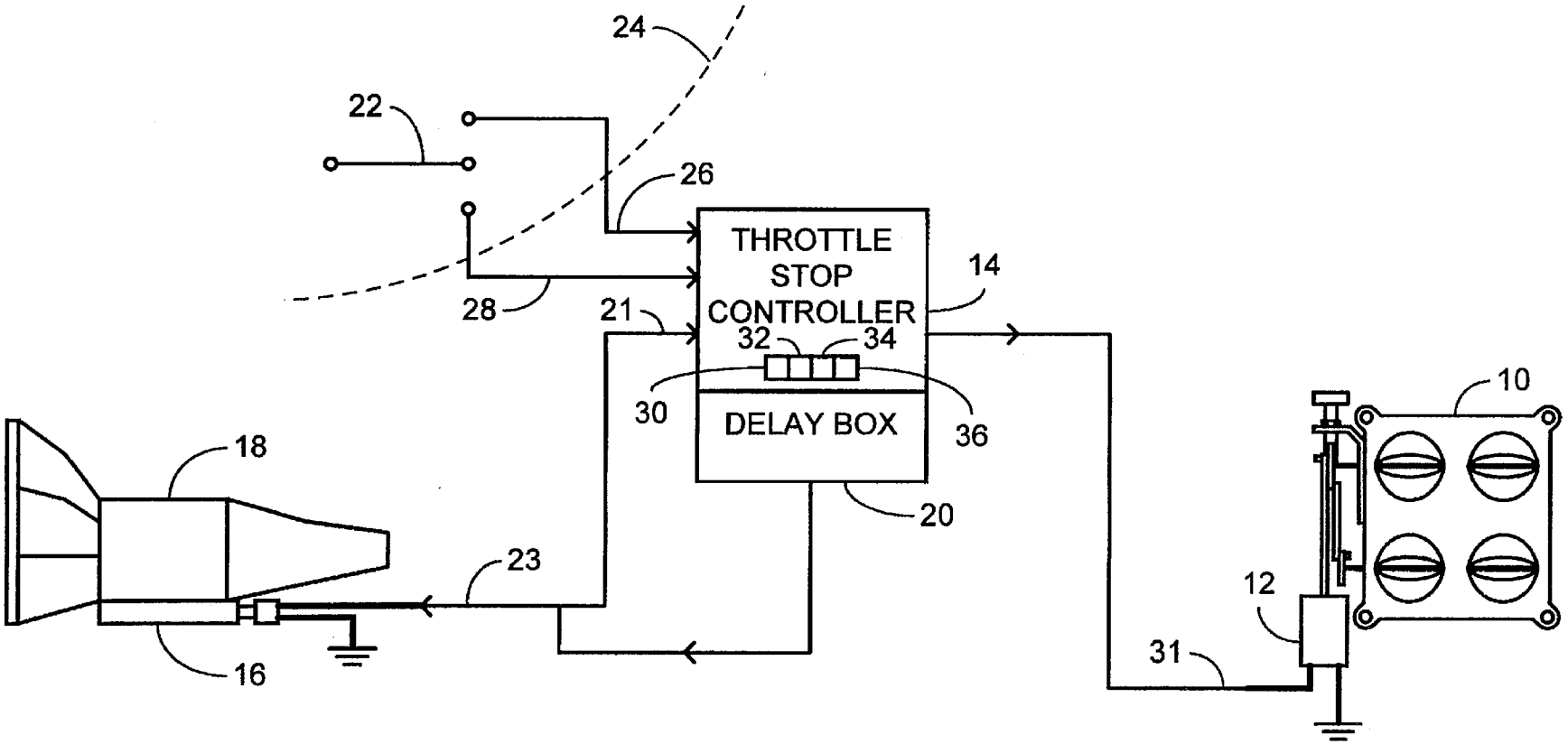
FIG. 1 is a schematic illustration of the time operated throttle of the present invention.

Referring first to FIG. 1, a four barrel carburetor throttle 10 is shown. The opening and closing of throttle 10 is controlled by an electric throttle stop solenoid 12. In this example, throttle 10 is normally open, and a signal from electric throttle stop solenoid 12 is necessary to close throttle 10. It will be evident to those skilled in the art that a normally closed throttle can also be used whereby a signal from electric throttle stop solenoid 12 is necessary to open throttle 10. Furthermore, instead of an electric throttle stop solenoid, a pneumatic throttle stop or hydraulic throttle stop can be used. Moreover, the throttle as illustrated in FIG. 1 is a carburetor throttle; however, the term throttle can also refer to a fuel injection valve, a valve for controlling a nitrous oxide container, etc. For purposes of the present description, a normally open electric throttle stop solenoid controlling a four barrel carburetor throttle will be described since this type of throttle is commonly incorporated in actual practice.

Electric throttle stop solenoid 12 is controlled by signals received from a throttle stop controller 14 along a line 31. Throttle stop controller 14 can take the form of well-known microprocessors or discrete logic used in the drag racing industry. Throttle stop controller 14 includes timer registers 30, 32, 34 and 36 which will help determine what type of signal to apply to electric throttle stop solenoid 12. While these timers will be described in greater detail below it is important to note that only timer registers 30 and 32 must be set for two-stage throttle operation, while timer registers 30, 32, 34 and 36 must all be set for four-stage throttle operation.

Throttle stop controller 14 is capable of receiving a launch signal along a line 21 from a delay box 20. This launch signal is also sent, along a line 23, to a transbrake solenoid 16 which operates a transbrake 18. Alternatively, a launch signal might first be sent to transbrake solenoid 16 and then sent, from transbrake solenoid 16, to throttle stop controller 14. Prior to the launch signal, throttle 10 is wide open, but transbrake 18 is activated. Upon receipt of the launch signal from delay box 20, transbrake solenoid 16 releases transbrake 18. As represented in FIG. 1, throttle stop controller 14 and delay box 20 have been illustrated as adjacent elements. In actual design, these two components can be formed from separate microprocessors or by utilizing a single microprocessor. Furthermore, discrete logic can be used for such processing components. FIG. 1 has also been simplified by eliminating components which are unnecessary for the description of the present invention but which are well known in the art. For instance, a standard 12 volt battery would typically provide power to the entire circuitry shown in FIG. 1.

A normally open, center-off switch 22 which is within a driver's cabin 24 can be activated to supply a signal to throttle stop controller 14 either along a line 26 or along a line 28. Signals along either lines 26 or 28 will adjust one or more of the values in timer registers 30, 32, 34, and 36 within throttle stop controller 14.

Figure 2:
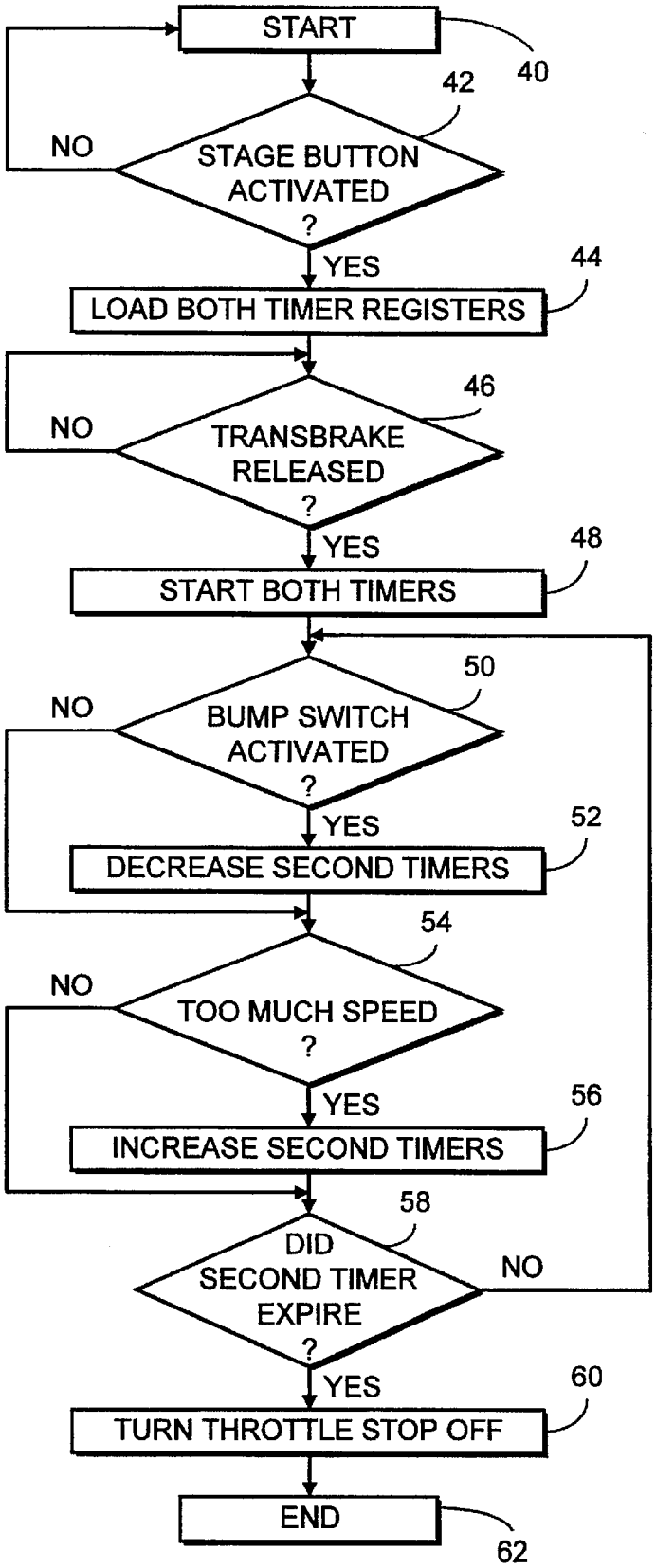
FIG. 2 is a simplified flow diagram embodying the steps run by a two-stage throttle stop controller in accordance with the present invention.

In order to understand the processing of throttle stop controller 14, reference is made to FIG. 2. Box 40 indicates the start of the processing of throttle stop controller 14. In decision box 42, a determination is made whether the stage button has been activated. This stage button can be activated either by a driver or automatically. If the stage button has not been activated, the software (or discrete logic) will return to start box 40. Alternatively, if the stage button has been activated, and assuming for purposes of FIG. 2, a two-stage throttle stop controller is being incorporated (i.e., only two timers are being used), the pre-launch values will be set for timer register 30 and timer register 32 (box 44). The values programmed into timers 30 and 32 will depend upon calculations of pre-launch factors including the anticipated speed of the vehicle over the track. Next, it is determined if a signal has been received along line 21 indicating that transbrake 18 has been released (box 46). With regard to the process described in box 46, the intent is simply to determine if launch has occurred. While in many products presently on the market, the time of launch is considered to be the time the transbrake is released, other techniques to determine launch time would be equally effective such as a signal from an inertia switch, aligned light sensor means, a driver-activated switch, etc. If launch has occurred, timer registers 30 and 32 are started by decrementing their values (box 48).

The flow diagram of FIG. 2 next represents a period during which throttle stop controller 14 will determine whether the driver activates switch 22. If the driver activates switch 22 so that a signal is provided along line 26, the value in timer 32 will be decreased. This signal has been described in box 50 as a "bump switch" since it will indicate a condition such as a bog or tire slipping which will be debilitating to the speed of the vehicle compared to the anticipated speed of the vehicle. When the bump switch is activated, the value in the second timer is decreased (box 52) and throttle 10 will remain closed for a shorter period of time than anticipated prior to the launch. Similarly, if the driver senses that the speed is too great, such as might be the case if a tail wind is sensed or traction is greater than anticipated, switch 22 will be connected to provide a signal along line 28 (box 54). In such instances, the value in timer register 32 will be increased (box 56), thereby resulting in a situation whereby throttle 10 is closed for a duration greater than anticipated prior to launch.

Next, as represented in box 58, the software determines if the value in the second timer 32 has expired. If so, the throttle is reopened (box 60) and the software ends (box 62). If the value in the second time has not yet expired, the software in FIG. 2 continues to monitor whether the driver has activated switch 22.

FIG. 2 provides an explanatory flow chart of the present invention. However, it will be noted that while the logic provided in FIG. 2 checks for a bump switch activation prior to checking for the activation of a switch indicating excessive speed, these two functions in essence can be performed simultaneously or even reversed. The steps have been shown in the recited order since, in most instances, the driver will encounter a post-launch condition which is debilitating to vehicle speed as compared to the anticipated speed as opposed to encountering a condition which will actually enhance the vehicle speed as compared to the anticipated speed. Furthermore, FIG. 2 assumes that somewhere along the line of checking for the activation of switch 22, the first timer will expire resulting in the activation of electric throttle stop solenoid 12. Without this assumption, box 60 which is representative of the deactivation of the throttle stop would be meaningless.

Figures 3A, 3B, 3C, 3D:
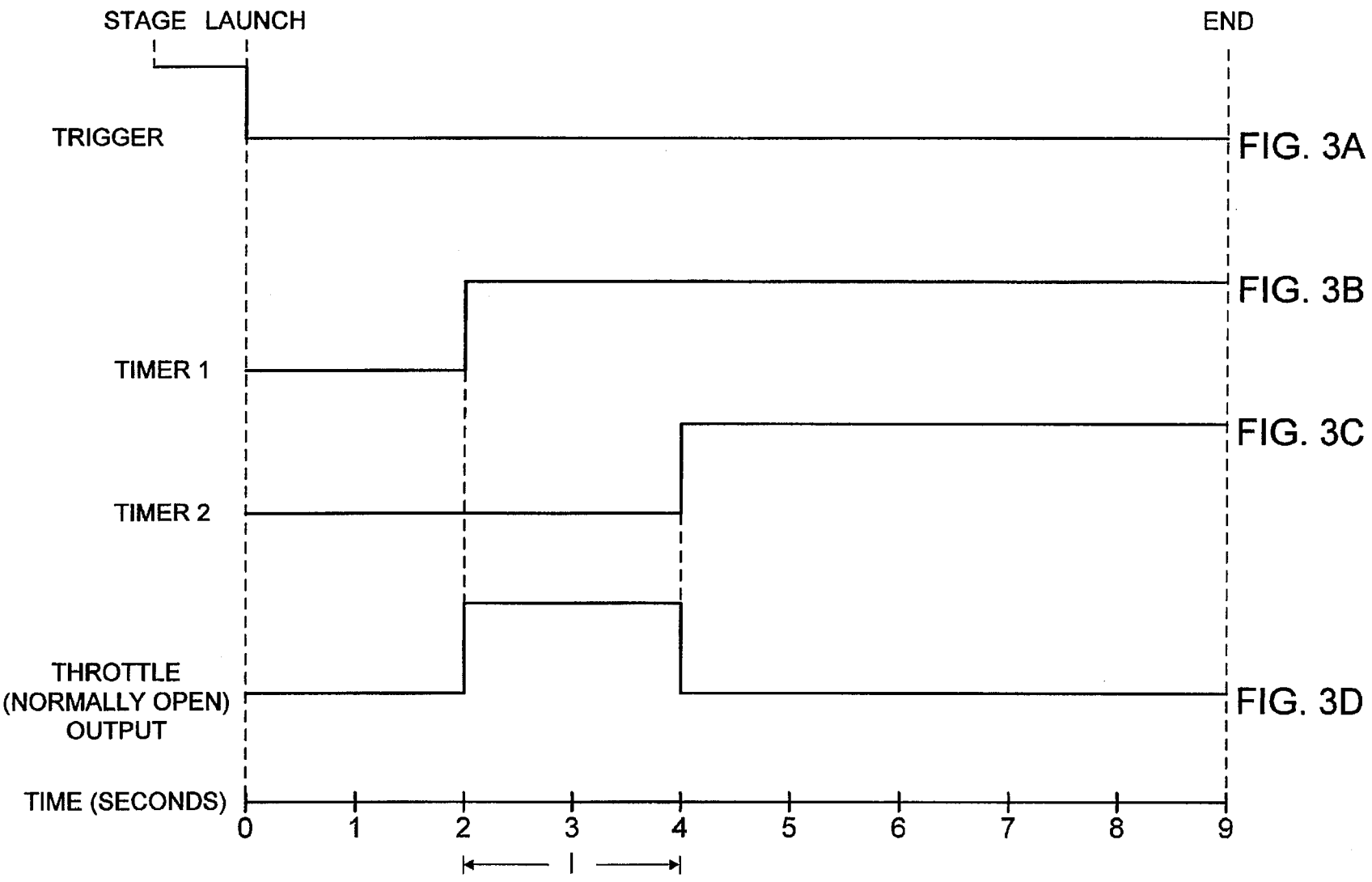
FIG. 3A–3D are a timing diagram of a two-stage time operated throttle which can be modified after launch in accordance with the present invention.

FIG. 3 illustrates an exemplary timing diagram of a two-stage controller which assumes an index time of nine seconds. The "TRIGGER" of FIG. 3A is the signal received by throttle stop controller 14 along line 21 from delay box 20. Delay box 20 controls timing elements of the drag racing vehicle for the period between stage and launch. It is also during this time that the predetermined values of timers 30, 32, 34 and 36 are set. Launch occurs upon release of transbrake 18 and represents "zero" time of the race. In this specific example, the value of TIMER 1 (timer register 30) has been set to two seconds while TIMER 2 (timer register 32) has been set to a value of four seconds. (Time registers 34 and 36 are set to zero in this two-stage example.) These timer values can be understood with reference to FIG. 3B and FIG. 3C. The signal shown in FIG. 3D is the signal provided to electric throttle stop solenoid 12 from throttle stop controller 14 along line 31. The result of this two-stage throttle stop controller is the closing of the throttle for a period I between two seconds after launch and four seconds after launch. The timing diagram provided in FIG. 3 at this point is the same as understood in the prior art. However, the software of the type in FIG. 2 can permit the driver, by activating switch 22, to increase, decrease, or shift the preset pulse at period I. The pulse illustrated in FIG. 3D during period I would be narrowed if the bump switch is activated (a signal along line 26), expanded if the switch is activated indicating excessive speed (a signal along line 28) or perhaps simply shifted to a later time if the driver's concern is the need for additional time at the beginning portion of the race to achieve maximum acceleration. While the flow chart of FIG. 2 shifts the value in timer 32, it is easily understood that variations to timer 30 or to both timers 30 and 32 are possible based on the intent of the designer. In either case, it is this modification of the signal in FIG. 3D, made subsequent to launch, which provides the advantages of the present invention.

Figures 4A, 4B, 4C, 4D, 4E, 4F:
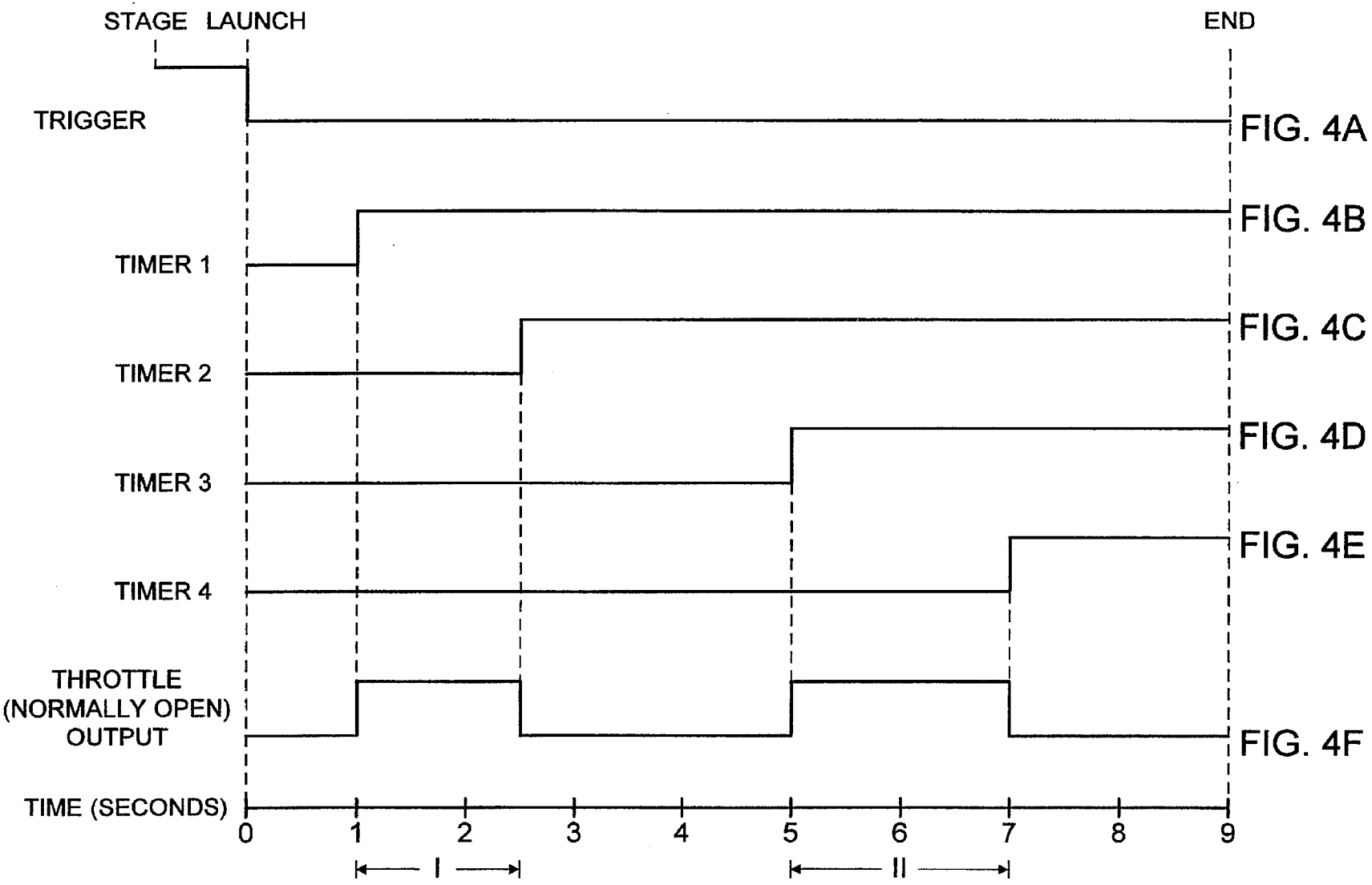
FIG. 4A–4F are a timing diagram of a four-stage time operated throttle which can be modified after launch in accordance with the present invention.

The timing diagram of FIG. 4 is similar in concept to the timing diagram of FIG. 3 with the exception that all four timers registers 30, 32, and 36 are implemented in the four-stage throttle controller example of FIG. 4. Timer register 30 is set to a value of one second, timer register 32 is set to a value of 2.5 seconds, timer register 34 is set to a value of five seconds, and timer register 36 is set to a value of seven seconds. The result of these preset conditions would be a throttle which is closed between the times defined as 1 second after launch and 2.5 seconds after launch (period I) and again between five seconds after launch and seven seconds after launch (period II). The software of the present invention permits the driver to activate switch 21 to increase, decrease, or shift the preset occurrence of the pulses of FIG. 4F based on post-launch conditions.

The present invention has been described in conjunction with the concept of controlling speed by controlling a four-barrel carburetor based on timing factors. However, instead of modifying speed based on the control of the four barrel carburetor, it is clearly foreseen that other means for adjusting the speed of a drag racing vehicle can also be controlled using the present invention. For instance, the control of a nitrous oxide canister to vary speed can also be controlled based on the teaching of the present invention. In fact, other engine factors beside speed can also be controlled by modifying the plurality of settings for the engine function, which have been preset prior to launch, based on post-launch factors. Additionally, while registers 30, 32, 34 and 36 have been described as being timers, these registers can instead be established to store distance values. Thus, instead of a throttle (or other engine function) being controlled based on time, they instead can be controlled based on post-launch distances which can be read from a wide variety of known odometers. The distance registers used in this embodiment can be made to count up to the preset value based on the distance the vehicle has travelled or count down from the distance value set in the register to zero based on an odometer reading.

It will be apparent from the foregoing description that the present invention provides a time operated or distance-based throttle and method which adapts to actual race conditions. While there has been shown and described what is presently considered the preferred two-stage and four-stage embodiments of this invention, it will be obvious to those skilled in the art that various changes and modifications may be made without departing from the broader aspects of this invention. For instance, although a single "normally open, center-off" switch 22 has been described to either increase or decrease the predetermined periods of time (or distance) in which the throttle will be closed, separate switches can certainly be incorporated. Additionally, while the throttle has been described as either being opened or closed, it should be understood with reference to the claims that such terms are not absolute but instead refer to comparative positions of the throttle. Moreover, while the modification of the predetermined period of times (or distances) in which the throttle will be closed have been described as being initiated by a driver-activated switch, electric sensors to gauge tire slippage, etc. can also be incorporated. A manual switch has been described in the preferred embodiment simply because the NHPA more routinely permits advances in the performance of drag racing vehicles when the advancement requires skill on the part of the driver as opposed to purely automatically implemented improvements.

It is, therefore, aimed in the appended claims to cover all such changes and modification as fall within the true scope and spirit of the invention.

I claim:

1. A time operated throttle for use on a drag racing vehicle comprising:

means for establishing prior to launch of said vehicle a first predetermined period of time during which said throttle will be closed based on an anticipated speed of said vehicle; and means for modifying said first predetermined period of time based on one or more actual race conditions sensed subsequent to launch.

2. The time operated throttle of claim 1 wherein said actual race conditions result in an actual speed which is less than said anticipated speed.

3. The time operated throttle of claim 2 whereby said means for modifying decreases said first predetermined period of time during which said throttle will be closed.

4. The time operated throttle of claim 1 wherein said actual race conditions result in an actual speed which is greater than said anticipated speed.

5. The time operated throttle of claim 4 whereby said means for modifying increases said first predetermined period of time during which said throttle will be closed.

6. The time operated throttle of claim 1 wherein said means for modifying said first predetermined period of time is activated by a driver-activated switch.

7. The time operated throttle of claim 1 whereby said means for establishing said first predetermined period of time during which said throttle will be closed includes a first timer set to a first value and a second timer set to a second value wherein said first predetermined period of time is equal to the difference in time between said first and second values.

8. The time operated throttle of claim 1 further comprising:

means for establishing a second predetermined period of time, subsequent to said first predetermined period of time, during which said throttle will be closed.

9. The time operated throttle of claim 8 further comprising:

means for modifying said second predetermined period of time based on said actual race conditions subsequent to launch.

10. The time operated throttle of claim 9 whereby said means for establishing a second predetermined period of time during which said throttle will be closed includes a third timer set to a third value and a fourth timer set to a fourth value wherein said second predetermined period of time is equal to the difference in time between said third and fourth values.

11. A method of controlling a throttle on a drag racing vehicle comprising the steps of:

establishing prior to launch of said vehicle a first predetermined period of time during which said throttle will be closed subsequent to launch of said vehicle; and modifying said first predetermined period of time based on one or more actual race conditions subsequent to launch.

12. The method of claim 11 further comprising the steps of:

initiating said modifying step by means of a driver-activated switch.

13. The method of claim 11 whereby said step of establishing said first predetermined period of time during which said throttle will be closed includes the steps of:

setting a first timer to a first value;

setting a second time to a second value; and subtracting said first value from said second value to determine said first predetermined period of time.

14. The method of claim 11 further comprising the step of:

establishing a second predetermined period of time, subsequent to said first predetermined period of time, during which said throttle will be closed.

15. The method of claim 14 further comprising the step of:

modifying said second predetermined period of time based on said actual race conditions subsequent to launch.

16. The method of claim 15 whereby said step of establishing a second predetermined period of time during which said throttle will be closed includes the steps of:

setting a third timer to a third value;

setting a fourth timer to a fourth value; and subtracting said third value from said fourth value to determine said second predetermined period of time.

17. A time operated throttle for use in a drag racing vehicle comprising:

means for selectively opening and closing said throttle;

a processor means capable of issuing an open throttle control signal and a close throttle control signal to said means for selectively opening and closing said throttle;

a first adjustable timer set prior to launch to a predetermined first value whereby, upon expiration of said first value, said close throttle signal is issued;

a second adjustable timer set prior to launch to a predetermined second value which is greater than said first value whereby, upon expiration of said second value, said open throttle control signal is issued; and means for modifying at least one of said first and second values subsequent to launch.

18. The time operated throttle of claim 17 wherein said means for selectively opening and closing said throttle is an electric solenoid.

19. The time operated throttle of claim 17 whereby initiation of the expiring of said first and second values commences at launch of said vehicle.

20. The time operated throttle of claim 19 whereby launch is determined by receipt by said processor means of a signal indicative of release of a transbrake.

21. The time operated throttle of claim 17 whereby said means for modifying includes a driver-controlled switch.

22. The time operated throttle of claim 17 further comprising:

a third adjustable timer set prior to launch to a predetermined third value which is greater than said second value whereby, upon expiration of said third value, said closed throttle signal is issued; and a fourth adjustable timer set prior to launch to a predetermined fourth value, which is greater than said third value whereby, upon expiration of said fourth value, said open throttle signal is issued.

23. The time operated throttle of claim 22 further comprising:

means for modifying at least one of said third and fourth values subsequent to launch.

24. An apparatus for use on a drag racing vehicle comprising:

means for establishing prior to launch of said vehicle a first predetermined distance during which said throttle will be closed based on an anticipated speed of said vehicle; and means for modifying said first predetermined distance based on one or more actual race conditions subsequent to launch.

25. The apparatus of claim 24 wherein said actual race conditions result in an actual speed which is less than said anticipated speed.

26. The apparatus of claim 25 whereby said means for modifying decreases said first predetermined distance during which said throttle will be closed.

27. The apparatus of claim 24 wherein said actual race conditions result in an actual speed which is greater than said anticipated speed.

28. The apparatus of claim 27 whereby said means for modifying increased said first predetermined distance during which said throttle will be closed.

29. The apparatus of claim 24 wherein said means for modifying said first predetermined distance is activated by a driver-activated switch.

30. The apparatus of claim 24 wherein said means for establishing said first predetermined distance during which said throttle will be closed includes a first register set to a first distance value and a second register set to a second distance value wherein said first predetermined distance is equal to the difference in distance between said first and second values.

31. The apparatus of claim 24 further comprising:

means for establishing a second predetermined distance during which said throttle will be closed.

32. The apparatus of claim 31 further comprising:

means for modifying said second predetermined distance based on said actual race conditions subsequent to launch.

33. The apparatus of claim 32 whereby said means for establishing a second predetermined distance during which said throttle will be closed includes a third register set to a third distance value and a fourth register set to a fourth distance value wherein said second predetermined distance is equal to the difference in distance between said third and fourth values.

34. A method of controlling a throttle on a drag racing vehicle comprising the steps of:

establishing prior to launch of said vehicle a first predetermined distance during which said throttle will be closed subsequent to launch of said vehicle; and modifying said first predetermined distance based on one or more actual race conditions subsequent to launch.

35. The method of claim 34 further comprising the step of:

initiating said modifying step by means of a driver-activated switch.

36. The method of claim 34 whereby said step of establishing said first predetermined distance during which said throttle will be closed includes the steps of:

setting a first register to a first distance value;

setting a second register to a second distance value; and subtracting said first value from said second value to determine said first predetermined distance.

37. The method of claim 34 further comprising the step of:

establishing a second predetermined distance during which said throttle will be closed.

38. The method of claim 37 further comprising the step of:

modifying said second predetermined distance based on said actual race conditions subsequent to launch.

39. The method of claim 38 whereby said step of establishing a second predetermined distance during which said throttle will be closed includes the steps of:

setting a third register to a third distance value;

setting a fourth register to a fourth distance value; and subtracting said third value from said fourth value to determine said second predetermined distance.

40. An apparatus for use in a drag racing vehicle comprising:

means for selectively opening and closing said throttle;

processor means capable of issuing an open throttle control signal and a closed throttle control signal to said means for selectively opening and closing said throttle;

a first adjustable register set prior to launch to a predetermined first distance whereby, upon said vehicle traveling said first distance value, said closed throttle signal is issued;

a second adjustable register set prior to launch to a predetermined second distance value which is greater than said first distance value, whereby, upon said vehicle traveling said second distance value, said open throttle control signal is issued; and means for modifying at least one of said first and second distance values subsequent to launch.

41. The apparatus of claim 40 wherein said means for selectively opening and closing said throttle is an electric solenoid.

42. The apparatus of claim 40 whereby said means for modifying includes a driver-controlled switch.

43. The apparatus of claim 40 further comprising:

a third adjustable register set prior to launch to a predetermined third distance value which is greater than said second distance value whereby, upon said vehicle traveling said third distance value, said closed throttle signal is issued; and a fourth adjustable register set prior to launch to a predetermined fourth distance value, which is greater than said third distance value whereby, upon said vehicle traveling said fourth distance value, said open throttle signal is issued.

44. The apparatus of claim 43 further comprising:

means for modifying at least one of said third and fourth distance values subsequent to launch.

* * * * *